US007780407B2

(12) United States Patent
Anderson et al.

(10) Patent No.: US 7,780,407 B2
(45) Date of Patent: Aug. 24, 2010

(54) ROTARY MACHINES AND METHODS OF ASSEMBLING

(75) Inventors: James P. Anderson, Clifton Park, NY (US); Robert J. Piechota, Albany, NY (US)

(73) Assignee: General Electric Company, Schenectady, NY (US)

( * ) Notice: Subject to any disclaimer, the term of this patent is extended or adjusted under 35 U.S.C. 154(b) by 1269 days.

(21) Appl. No.: 11/325,596

(22) Filed: Jan. 4, 2006

(65) Prior Publication Data

US 2007/0154306 A1 Jul. 5, 2007

(51) Int. Cl.
*F01D 11/00* (2006.01)
*F01D 9/04* (2006.01)

(52) U.S. Cl. ..... 415/209.2; 415/210.1; 415/230; 29/402.06; 29/402.12; 29/402.14; 29/402.15; 29/889.1; 29/889.22

(58) Field of Classification Search ..... 415/189–190, 415/209.2, 209.3, 209.4, 210.1, 230–231, 415/173.7, 174.5; 29/402.01, 402.06, 402.09, 29/402.11, 402.03, 402.12, 402.14, 402.15, 29/402.17, 889.1, 889.2, 889.22
See application file for complete search history.

(56) References Cited

U.S. PATENT DOCUMENTS 3,881,842 A 5/1975 Kosyak et al.
4,509,238 A 4/1985 Lee et al.
4,616,975 A 10/1986 Duncan
5,222,862 A 6/1993 Groenendaal, Jr. et al.
5,249,918 A * 10/1993 Knorowski ..... 415/209.2
5,253,976 A 10/1993 Cunha
5,524,340 A * 6/1996 Galbraith et al. ..... 29/889.1
5,743,711 A * 4/1998 Fournier et al. ..... 415/209.2
6,742,988 B2 6/2004 Mundra et al.
6,776,577 B1 8/2004 Chu et al.
6,821,086 B1 11/2004 Brisson et al.
6,860,718 B2 3/2005 Suzuki et al.
6,896,482 B2 5/2005 Parry
7,097,423 B2 8/2006 Burdgick
2004/0253095 A1* 12/2004 Sasaki et al. ..... 415/191
2007/0110575 A1* 5/2007 Burdgick et al. ..... 415/209.2

* cited by examiner

*Primary Examiner*—Christopher Verdier
(74) *Attorney, Agent, or Firm*—Armstrong Teasdale LLP

(57) ABSTRACT

A rotary machine and a method of assembling a rotary machine having a casing extending at least partially around a rotor are provided. The method includes providing a diaphragm patch ring. The method also includes assembling a diaphragm assembly by configuring a diaphragm bore portion to receive the diaphragm patch ring and forming a diaphragm patch member sub-assembly by coupling the diaphragm patch ring to the configured diaphragm bore portion, such that the diaphragm bore portion defines at least one dowel passage and at least one bolt passage. The method further includes inserting at least one dowel generally radially into the at least one dowel passage, inserting at least one fastening bolt generally radially into the at least one bolt passage to secure the diaphragm patch ring to the diaphragm bore portion, and positioning the diaphragm assembly in a gap formed by the casing and the rotor.

20 Claims, 9 Drawing Sheets

ROTARY MACHINES AND METHODS OF ASSEMBLING

BACKGROUND OF THE INVENTION

This invention relates generally to rotary machines and more particularly, to diaphragm patch rings for use in a rotary machine.

At least some steam turbines have a defined steam path which includes, in serial-flow relationship, a steam inlet, a turbine, and a steam outlet. Many of these steam turbines include stationary nozzle segments that direct a flow of steam towards rotating buckets, or turbine blades, that are coupled to a rotatable member. The nozzle airfoil construction is typically called a diaphragm assembly. Each diaphragm assembly is usually referred to as a stage and most steam turbines have a configuration that includes a plurality of diaphragm assembly stages.

Steam leakage, either out of the steam path or into the steam path, from an area of higher pressure to an area of lower pressure may adversely affect an operating efficiency of the turbine. For example, steam-path leakage in the turbine between a rotating rotor shaft of the turbine and a circumferentially surrounding turbine casing may lower the efficiency of the turbine. Additionally, steam-path leakage between a shell and the portion of the casing extending between adjacent turbines may reduce the operating efficiency of the steam turbine and over time, may lead to increased fuel costs.

In addition to facilitating steam flow, to facilitate minimizing steam-path leakage as described above, at least some known steam turbines use a plurality of labyrinth seals that are integral to the diaphragm assemblies. The seals are typically ring segments that are inserted into circumferential grooves at the radially innermost section of the diaphragm assembly, often referred to as a bore. Some known labyrinth seals include longitudinally spaced rows of labyrinth seal teeth which are used to seal against pressure differentials that may be present in the steam turbine.

Some steam turbine maintenance activities periodically include reducing the associated rotor diameters for a variety of reasons that include accommodating new features such as longer buckets, enhancing rotor stability, and/or mitigating rotor thrust values. In some of these instances, it is desirable to retain and reuse the existing diaphragm assemblies. In the event that the aforementioned seals alone cannot be modified to accommodate the extended gap between the diaphragm assemblies and the rotor, the existing diaphragm may be modified such that the bore of the diaphragm assembly and associated seals can mate with the reduced rotor diameter. In those steam turbine configurations where sufficient radial space exists, welding a diaphragm extension to existing diaphragms may suffice. Furthermore, alternative methods of extension attachment may be considered, such as for example, coupling extensions to existing diaphragms with a dowel-type configuration. However, in some known steam turbines, sufficient space for the aforementioned welding and dowel configurations may not be present and a low-profile, self-supporting configuration may be a solution.

BRIEF DESCRIPTION OF THE INVENTION

In one aspect, a method of assembling a rotary machine having a casing extending at least partially around a rotor is provided. The method includes providing a diaphragm patch ring. The method also includes assembling a diaphragm assembly by configuring a diaphragm bore portion to receive the diaphragm patch ring and forming a diaphragm patch member sub-assembly by coupling the diaphragm patch ring to the configured diaphragm bore portion. The method further includes positioning the diaphragm assembly in a gap formed by the casing and the rotor.

In another aspect, a diaphragm assembly for a steam turbine is provided. The assembly includes a substantially annular radially inner member configured to extend substantially circumferentially within the steam turbine. The assembly also includes a substantially annular diaphragm patch member sub-assembly configured to extend substantially circumferentially within the steam turbine. The sub-assembly includes a substantially annular diaphragm patch ring and the diaphragm patch member sub-assembly is coupled to the inner member.

In a further aspect, a rotary machine is provided. The machine includes at least one rotor and at least one stationary machine casing extending at least partly circumferentially around the rotor such that a clearance gap is defined between the rotor and the casing. The machine also includes at least one diaphragm assembly. The diaphragm assembly is positioned within the clearance gap defined between the rotor and the stationary machine casing. The diaphragm assembly includes a substantially annular radially inner member configured to extend substantially circumferentially within the rotary machine. The assembly also includes a substantially annular diaphragm patch member sub-assembly configured to extend substantially circumferentially within the rotary machine. The sub-assembly includes a substantially annular diaphragm patch ring. The diaphragm patch member sub-assembly is coupled to the inner member.

DETAILED DESCRIPTION OF THE INVENTION

Figure 1:
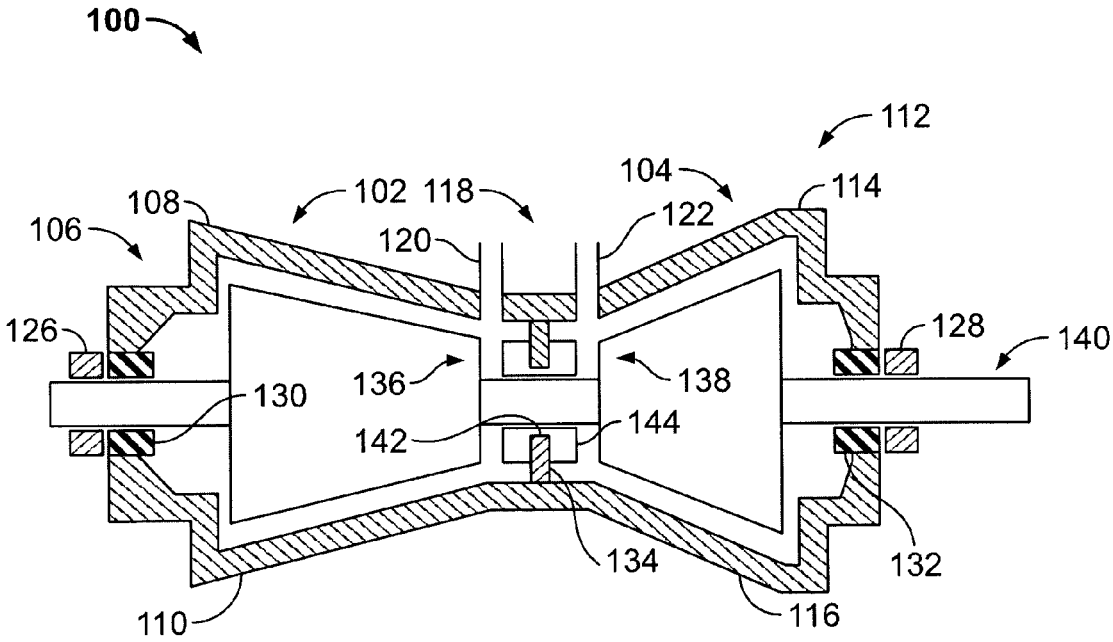
FIG. 1 is a schematic illustration of an exemplary opposed flow steam turbine engine.

FIG. 1 is a schematic illustration of an exemplary opposed-flow steam turbine engine 100 including a high pressure (HP) section 102 and an intermediate pressure (IP) section 104. An HP outer shell, or casing, 106 is divided axially into upper and lower half sections 108 and 110, respectively. Similarly, an IP outer shell 112 is divided axially into upper and lower half sections 114 and 116, respectively. A central section 118 positioned between HP section 102 and IP section 104 has a high pressure steam inlet 120 and an intermediate pressure steam inlet 122. Within casings 106 and 112, HP section 102 and IP section 104, respectively, are arranged in a single bearing span supported by journal bearings 126 and 128. Steam seal units 130 and 132 are located inboard of each journal bearing 126 and 128, respectively.

An annular section divider 134 extends radially inwardly from central section 118 towards a rotor shaft 140 that extends between HP section 102 and IP section 104. More specifically, divider 134 extends circumferentially around a portion of rotor shaft 140 between a first HP section inlet nozzle 136 and a first IP section inlet nozzle 138. Divider 134 is received in a channel 142 defined in a packing casing 144. More specifically, channel 142 is a C-shaped channel that extends radially into packing casing 144 and around an outer circumference of packing casing 144, such that a center opening of channel 142 faces radially outwardly.

During operation, high pressure steam inlet 120 receives high pressure/high temperature steam from a steam source, for example, a power boiler (not shown in FIG. 1). Steam is routed through HP section 102 from inlet nozzle 136 wherein work is extracted from the steam to rotate rotor shaft 140 via a plurality of turbine blades, or buckets (not shown in FIG. 1) that are coupled to shaft 140. Each set of buckets has a corresponding diaphragm assembly (not shown in FIG. 1) that facilitates routing of steam to the associated buckets. The steam exits HP section 102 and is returned to the boiler wherein it is reheated. Reheated steam is then routed to intermediate pressure steam inlet 122 and returned to IP section 104 via inlet nozzle 138 at a reduced pressure than steam entering HP section 102, but at a temperature that is approximately equal to the temperature of steam entering HP section 102. Work is extracted from the steam in IP section 104 in a manner substantially similar to that used for HP section 102 via a system of buckets and diaphragm assemblies (not shown in FIG. 1). Accordingly, an operating pressure within HP section 102 is higher than an operating pressure within IP section 104, such that steam within HP section 102 tends to flow towards IP section 104 through leakage paths that may develop between HP section 102 and IP section 104. One such leakage path may be defined extending through packing casing 144 axially along rotor shaft 140.

It should be noted that although FIG. 1 illustrates an opposed-flow high pressure and intermediate pressure steam turbine combination, as will be appreciated by one of ordinary skill in the art, the present invention is not limited to being used with high pressure and intermediate pressure turbines and can be used with any individual turbine or multiple turbine combinations as well, including, but not limited to low pressure turbines. In addition, the present invention is not limited to being used with opposed flow and double flow turbines, but rather may be used with single flow steam turbines as well.

Figure 2:
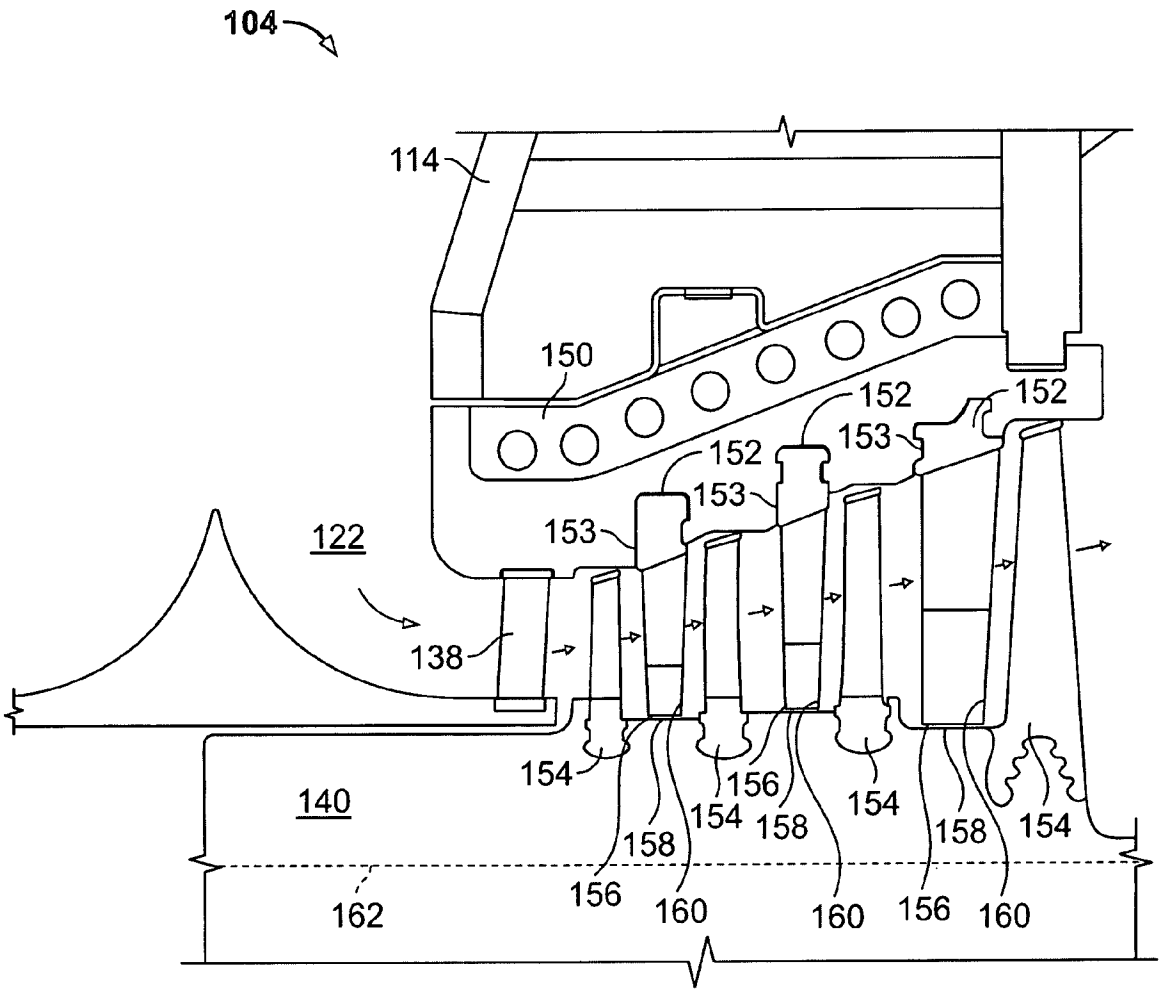
FIG. 2 is a schematic side perspective of a portion of the steam turbine engine in FIG. 1.

FIG. 2 is a schematic side perspective of a portion of IP section 104 of steam turbine engine 100 (shown in FIG. 1). Section 104 includes upper half casing 114 that is bolted to lower half casing 116 (not shown in FIG. 2) when section 104 is fully assembled. A nozzle carrier top half 150 mates to radially inner surfaces of casing 114 such that carrier 150 acts as a radial inward extension of casing 114. Such mating facilitates maintaining nozzle carrier 150 in a substantially fixed position with respect to turbine rotor 140. Nozzle carrier 150 facilitates substantially fixed support for nozzle 138 as well as diaphragm assemblies 152 via substantially annular diaphragm grooves 153. A nozzle carrier bottom half (not shown in FIG. 2) is coupled to lower half casing 116 and receives nozzle 138 and assemblies 152 in a manner similar to carrier top half 150. Rotatable turbine blades, or buckets 154 are coupled to rotor 140.

Steam enters section 104 via IP section steam inlet 122 and is transported through section 104 as illustrated by the arrows. Inlet nozzle 138 and diaphragm assemblies 152 facilitate directing steam flow to buckets 154. Diaphragm assemblies 152 also facilitate mitigation of steam flow losses from the primary steam flow path of nozzle-to-bucket-to-nozzle, etc. via an axial gap 156 formed between a radially innermost portion of diaphragm assemblies 160 and a rotor surface 158. Diaphragm assemblies 152 are discussed further below.

Figure 3:
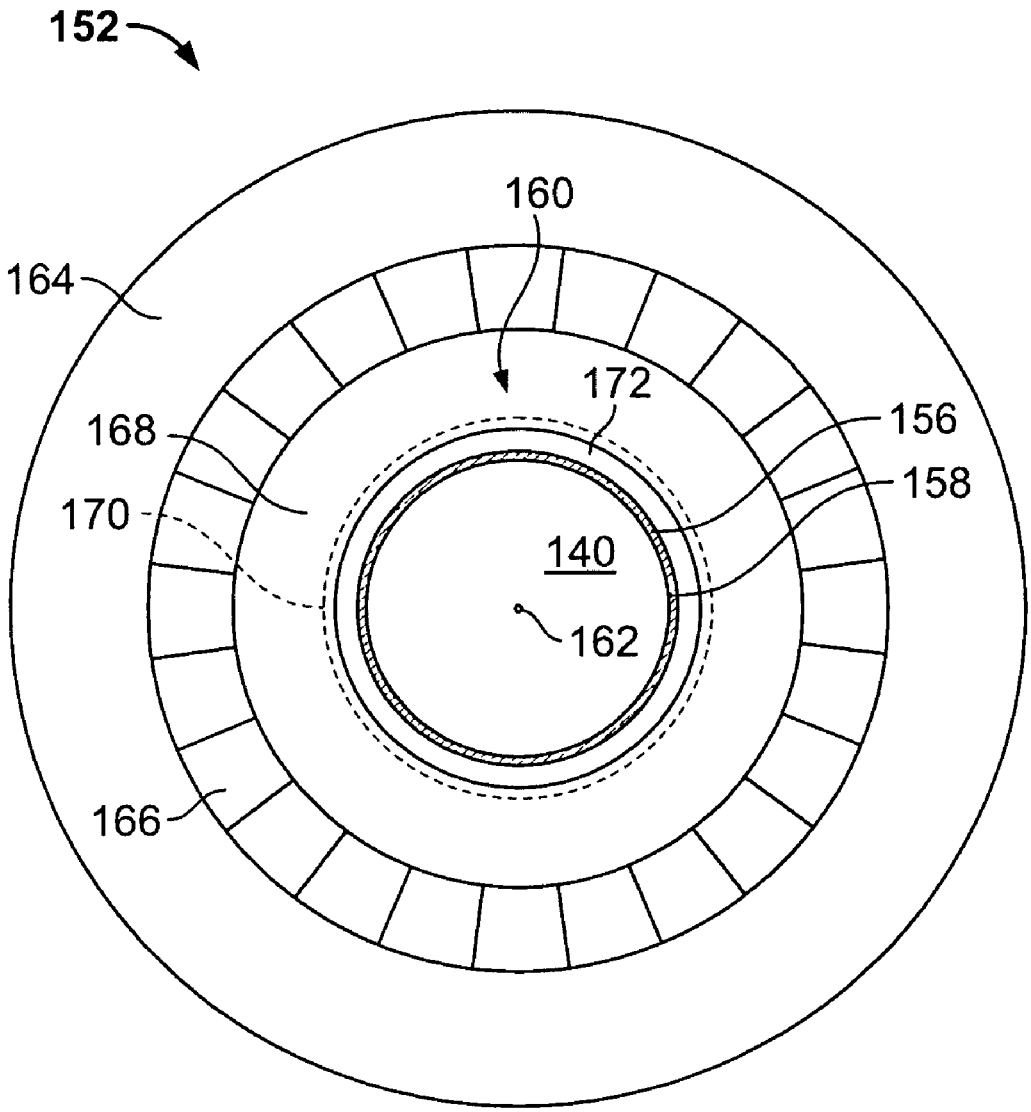
FIG. 3 is a schematic axial perspective of an exemplary diaphragm assembly prior to modification that may be used with the steam turbine engine in FIG. 1.
Figure 4:
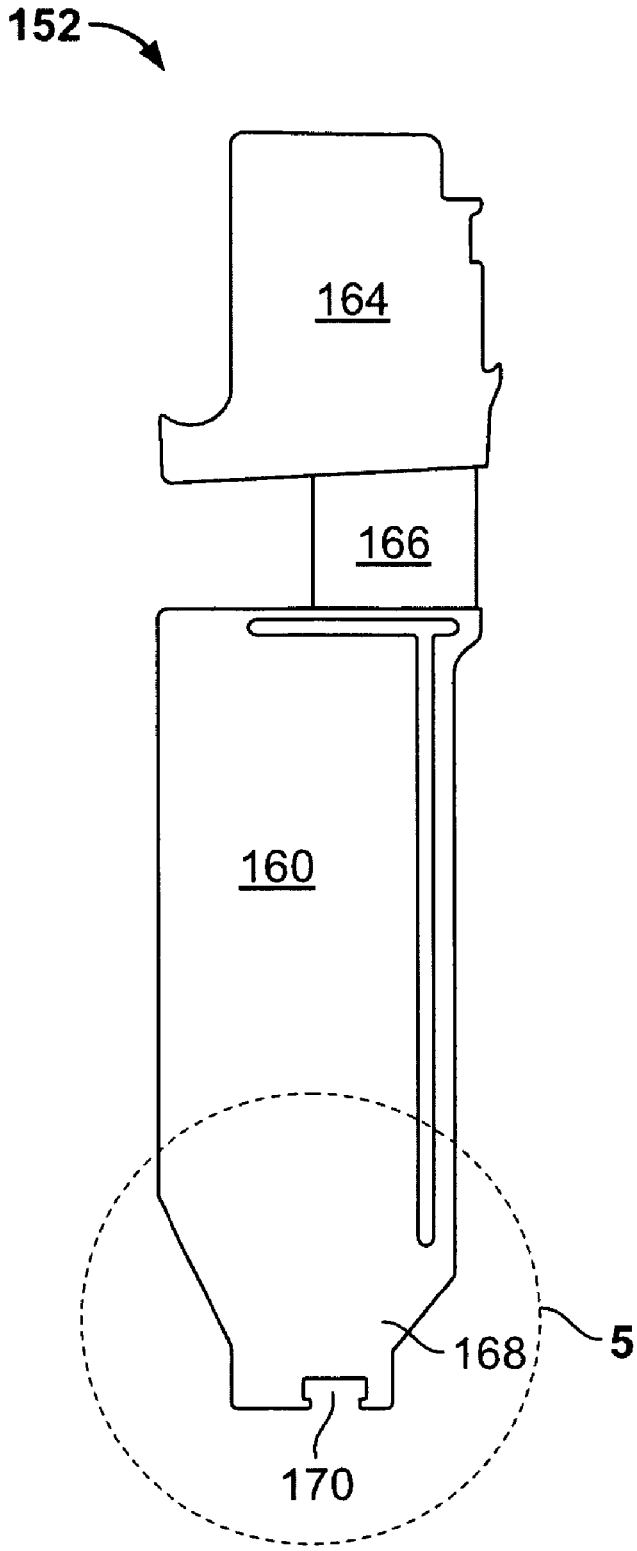
FIG. 4 is a schematic side perspective of a portion of the diaphragm assembly in FIG. 3 prior to modification.

FIG. 3 is a schematic axial perspective of an exemplary diaphragm assembly 152 prior to modification that may be used with steam turbine engine 100 (shown in FIG. 1), and FIG. 4 is a schematic side perspective of a portion of diaphragm assembly 152 prior to modification. In one embodiment, diaphragm assembly 152 is a last stage diaphragm assembly 152 of turbine engine 100. Diaphragm assembly 152 has a substantially annular outer member that is inserted into similarly shaped grooves formed within nozzle carrier 150. In the exemplary embodiment, assembly 152 is formed of two substantially identical portions (not shown in FIG. 3) and forms a unitized assembly 152 when both portions are inserted. Typically, assembly 152 is formed from at least two half-sections that are "rolled" into diaphragm grooves 153 (shown in FIG. 2) and are split at a horizontal centerline formed between the "9 O'clock" and "3 O'clock" positions. This line is illustrated with the horizontal dotted line shown in FIG. 3.

Assembly 152 also has a plurality of nozzles 166 that facilitate steam flow through engine 100 as discussed above. Assembly 152 further has a substantially annular inner member 160 that includes a radially innermost portion 168, referred to as a bore portion, or bore. Bore portion 168 forms a substantially annular groove 170 that extends substantially circumferentially within steam turbine engine 100 and is configured to receive a substantially arcuate seal ring segment 172. Nozzles 166 are spaced circumferentially between members 160 and 164 and each extends substantially radially between inner and outer members 160 and 164, respectively. Turbine rotor shaft 140 with centerline 162 and rotor surface 158, and gap 156 formed by segment 172 and rotor surface 158 are illustrated in FIG. 3 for perspective. FIG. 4 illustrates a portion of assembly 152 with a dotted line and is labeled "5" that is expanded in FIG. 5 and discussed further below.

Figure 5:
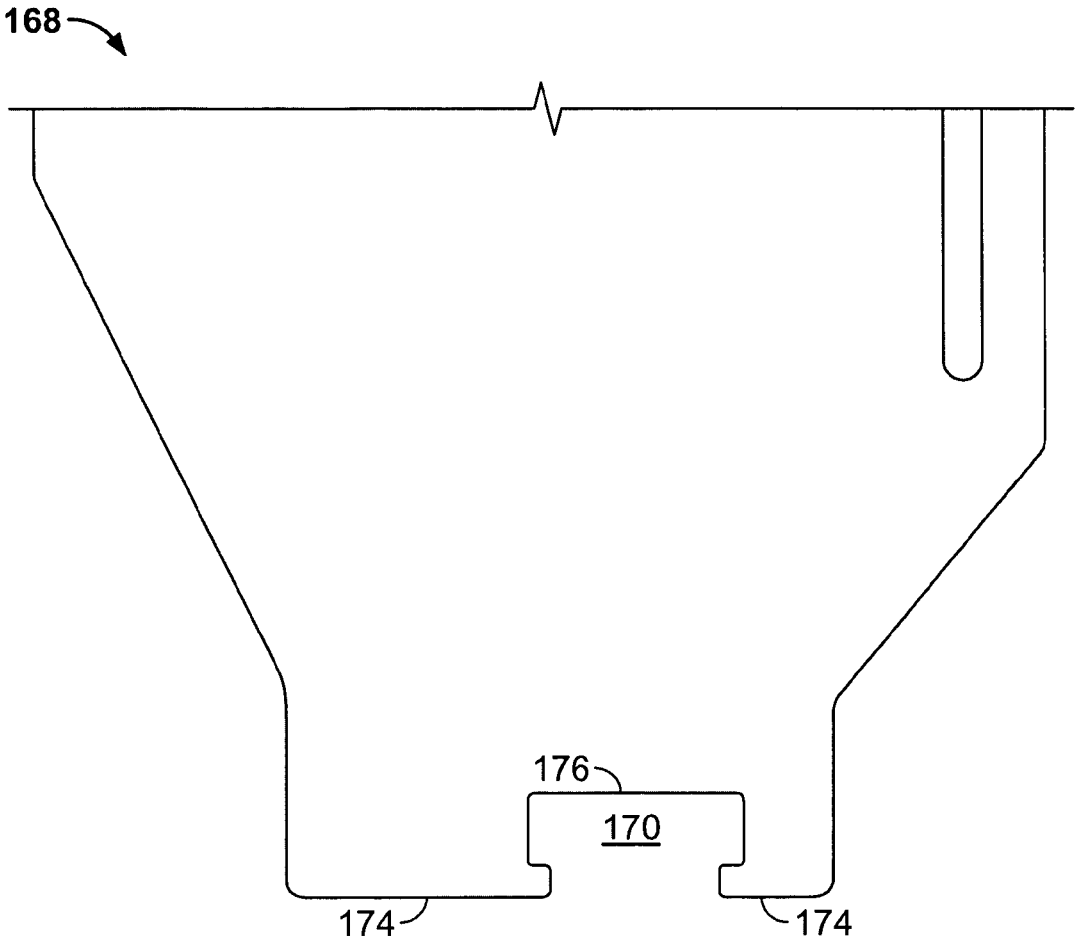
FIG. 5 is an expanded side perspective of the diaphragm assembly bore portion in FIG. 4 prior to modification.

FIG. 5 is an expanded side perspective of diaphragm assembly bore portion 168 in FIG. 4 prior to modification. Groove 170 is at least partially formed via at least one radially outermost surface 174 and groove radially innermost surface 176.

Figure 6:
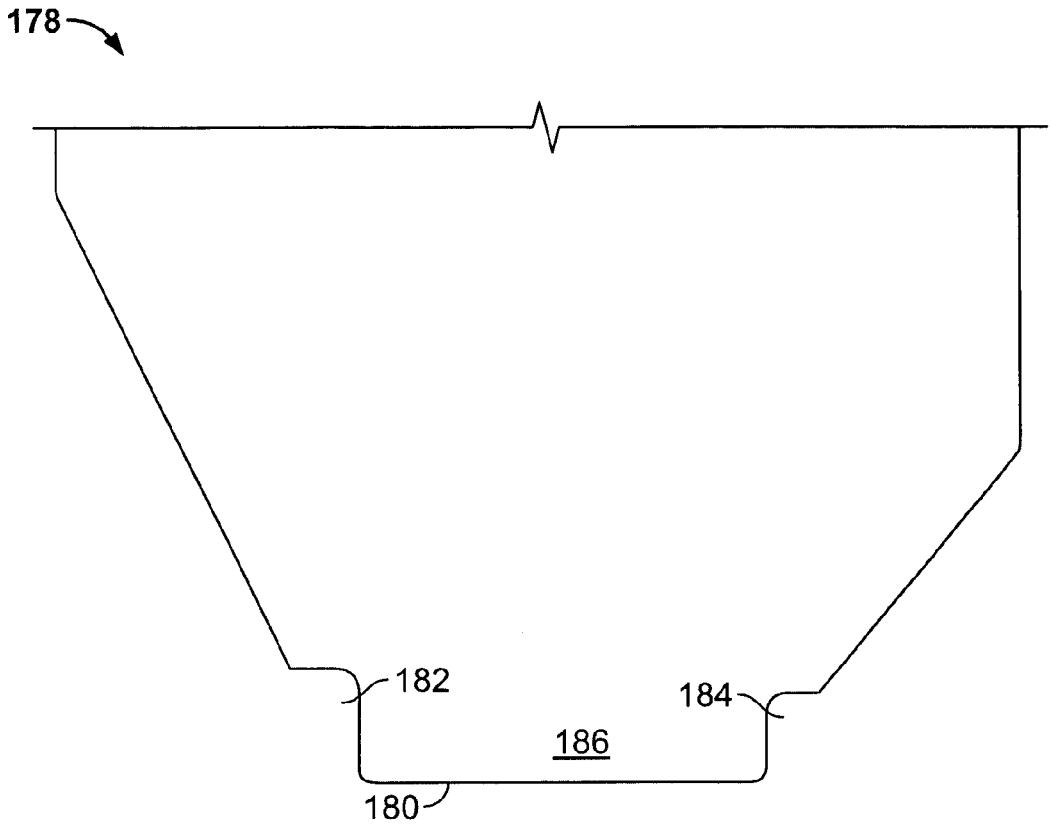
FIG. 6 is a side perspective of the exemplary bore portion in FIG. 5 machined to receive a diaphragm patch ring.

FIG. 6 is a side perspective of modified bore portion 178 that is bore portion 168 machined to receive a diaphragm patch ring (not shown in FIG. 6). Portion 168 is machined using techniques well known in the art to remove groove 170 (shown in FIG. 5). At least one surface 174 is machined to be substantially coplanar with surface 176 (both shown in FIG. 5) to form at least one substantially annular radially inner mating surface 180. Additional machining may be used to facilitate receipt of a diaphragm patch ring, for example, machining portion 178 to form a substantially annular axially upstream groove 182 and a substantially annular axially downstream groove 184 such that they form a protrusion, or tongue 186 portion for a "tongue and groove" configuration as discussed further below. Alternatively, inner member 160 that has modified bore portion 178 may be formed by casting.

Figure 7:
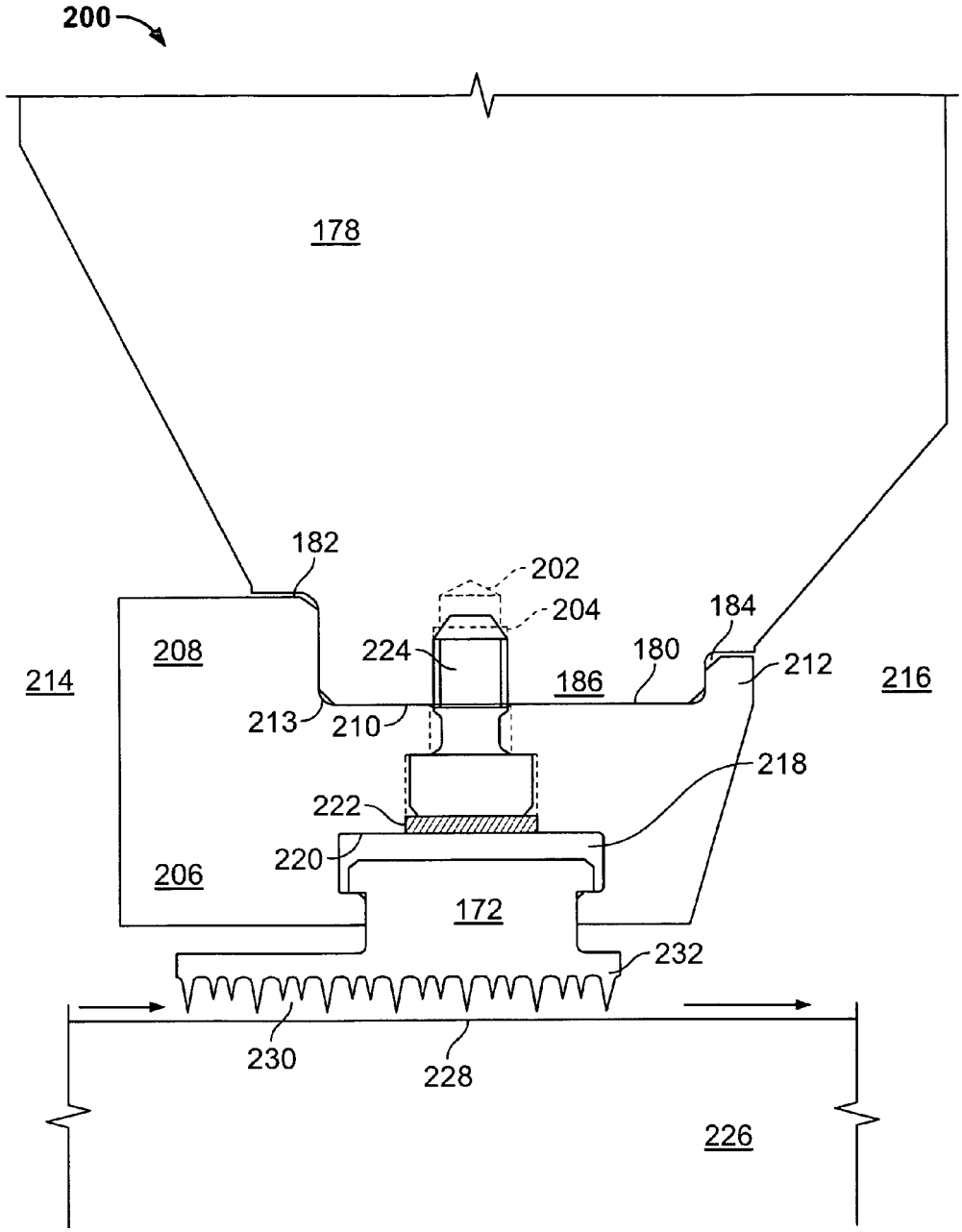
FIG. 7 is a side perspective of an exemplary diaphragm patch member sub-assembly that has the modified bore portion in FIG. 6.

FIG. 7 is a side perspective of a diaphragm patch member sub-assembly 200 that has modified bore portion 178 with substantially annular radially inner mating surface 180. At least a portion of each of a plurality of open passages that will eventually form dowel passages 202 and bolt passages 204 are machined substantially radially into modified bore portion 178 from surface 180. Passages 202 and 204 will be fully formed when a machined diaphragm patch ring 206 is coupled to portion 178 as, discussed further below. Modified bore portion 178 also has grooves 182 and 184 forming tongue-like protrusion 186 as discussed above.

Diaphragm patch ring 206 may be formed by machining a cast member, a forged member, or a plate (none of which are shown in FIG. 7) to a set of predetermined dimensions. Ring 206 is substantially annular with a substantially annular axially upstream protrusion 208, at least one substantially annular mating surface 210 and a substantially annular axially downstream protrusion 212. Protrusions 208 and 212 in cooperation with at least one surface 210 form the groove portion 213 of the tongue and groove configuration discussed further below. Furthermore, protrusions 208 and 212 are sized to account for the upstream pressure in region 214 acting on protrusion 208 being greater than the downstream pressure in region 216 acting on protrusion 212. This configuration tends to mitigate any potential axial displacement of ring 206 due to the differential pressure acting axially on ring 206.

A substantially annular seal ring groove 218 with a substantially annular radially outermost surface 220 is formed within patch ring 206. At least a portion of each of a plurality of open passages that will eventually form dowel passages 202 and bolt passages 204 are machined substantially radially into ring 206 extending from surface 210 to surface 220. Passages 202 and 204 are machined with dimensions and with spacing substantially similar to those for modified bore portion 178.

As discussed above, the method of forming diaphragm assembly 152 with two half sections applies to sub-assembly 200. Sub-assembly 200 is assembled by positioning a section of ring 206 against a section of modified bore portion 178 such that the mating surfaces 180 and 210 are in contact and passages 202 and 204 formed in bore 178 and ring 206 are in substantially radial alignment such that they may receive the associated fasteners of which bolt 224 is illustrated and dowels are not illustrated. In other words, groove 213 formed in ring 206 is rolled over tongue 186 formed in modified bore portion 178. The tongue and groove configuration formed by ring 206 and bore 178 serves to mitigate any potential axial displacement of ring 206 due to the aforementioned differential pressure acting axially on ring 206 as described above.

In the exemplary embodiment, the predetermined dimensions of tongue 186 and groove 213 are such that a contact friction fit between the two components is effected wherein the upstream portion of tongue 186 and protrusion 208 provide substantially most of the coupling force for coupling ring 206 to bore portion 178. In operation, as steam is admitted to steam turbine 100 and bore portion 178 and ring 206 expand as heated causing the coupling force between ring 206, bore portion 178 to increase. In this manner, a low-profile, self-supporting configuration for sub-assembly 200 is provided. When steam turbine 100 is removed from service and ring 206 and bore portion 178 are cooled, sufficient coupling force between ring 206 and bore portion 178 is maintained.

At least one bolt 224 is inserted generally radially into at least one bolt passage 204 to fixedly couple ring 206 to bore portion 178. At least one dowel (not shown in FIG. 7) is inserted generally radially into at least one dowel passage 202 to facilitate axial, radial and circumferential alignment as well as to facilitate mitigating any potential for circumferential displacement due to torsional forces that may develop from, for example, steam forces acting on seal ring segment 172 or steam swirl in the vicinity of nozzles 166 (shown in FIG. 4). Sealing caps 222 are inserted into passages 202 and 204 at surface 220 to mitigate any potential for bolt 224 or dowel release from associated passages 202 and 204, respectively. Typically, a friction fit for caps 222 is sufficient, however, additional means of securing caps 222 within passages 202 and 204, such as sealants or tack welding, may be used.

In the exemplary embodiment, bolts 224 and the dowels provide a coupling force to cooperate with the aforementioned friction fit force between protrusion 208 and tongue 186 to carry the load associated with sub-assembly 200. Alternatively, the predetermined dimensions of tongue 186 and groove 213 may be formed such that bolts 224 and the dowels merely provide captivation and alignment between ring 206 and bore portion 178 and the number of bolts 224 and dowels may be reduced or eliminated.

Further alternatively, passages 202 and the associated dowels may be eliminated for protrusions 208 and 212 and tongue 186 being keyed, notched or having lipped protrusions added to perform the function of mitigating circumferential displacement.

Also illustrated in FIG. 7 are seal ring segment 172, modified rotor 226, rotor surface 228 and gap 230 formed by rotor surface 228 and seal teeth 232. Rotor 226 has a smaller diameter than rotor 140 (shown in FIG. 3). Gap 230 and teeth 232 are a portion of a labyrinth seal system that mitigates steam flow along surface 228 from high pressure region 214 to low pressure region 216 as illustrated by the arrows.

Figure 8:
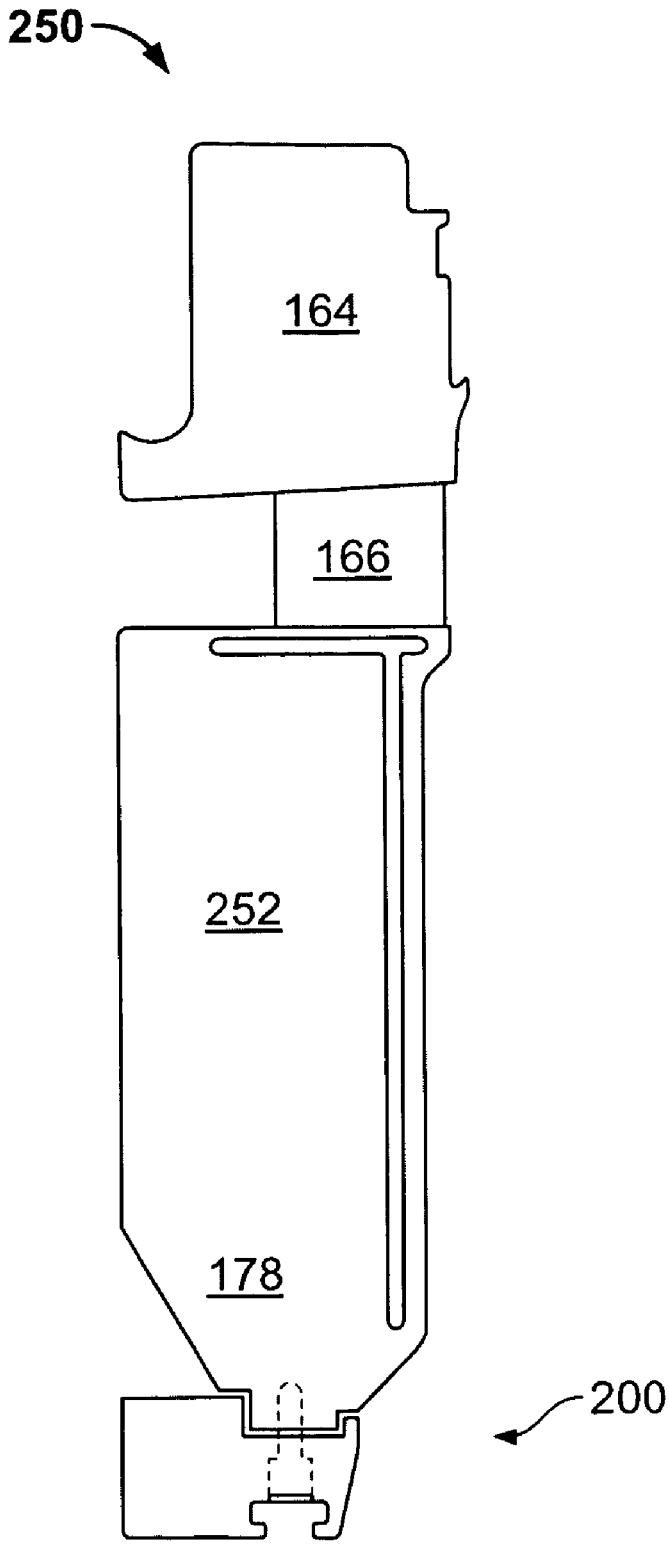
FIG. 8 is a schematic side perspective of a portion of a diaphragm assembly that has received the exemplary diaphragm patch member sub-assembly in FIG. 7.

FIG. 8 is a schematic side perspective of a portion of modified diaphragm assembly 250 that has received diaphragm patch member sub-assembly 200. Assembly 250 has a modified inner member 252 that has modified bore portion 178. Outer member 164 and nozzle 166 are substantially similar to those components associated with pre-modified diaphragm assembly 152 (shown in FIG. 4).

Figure 9:
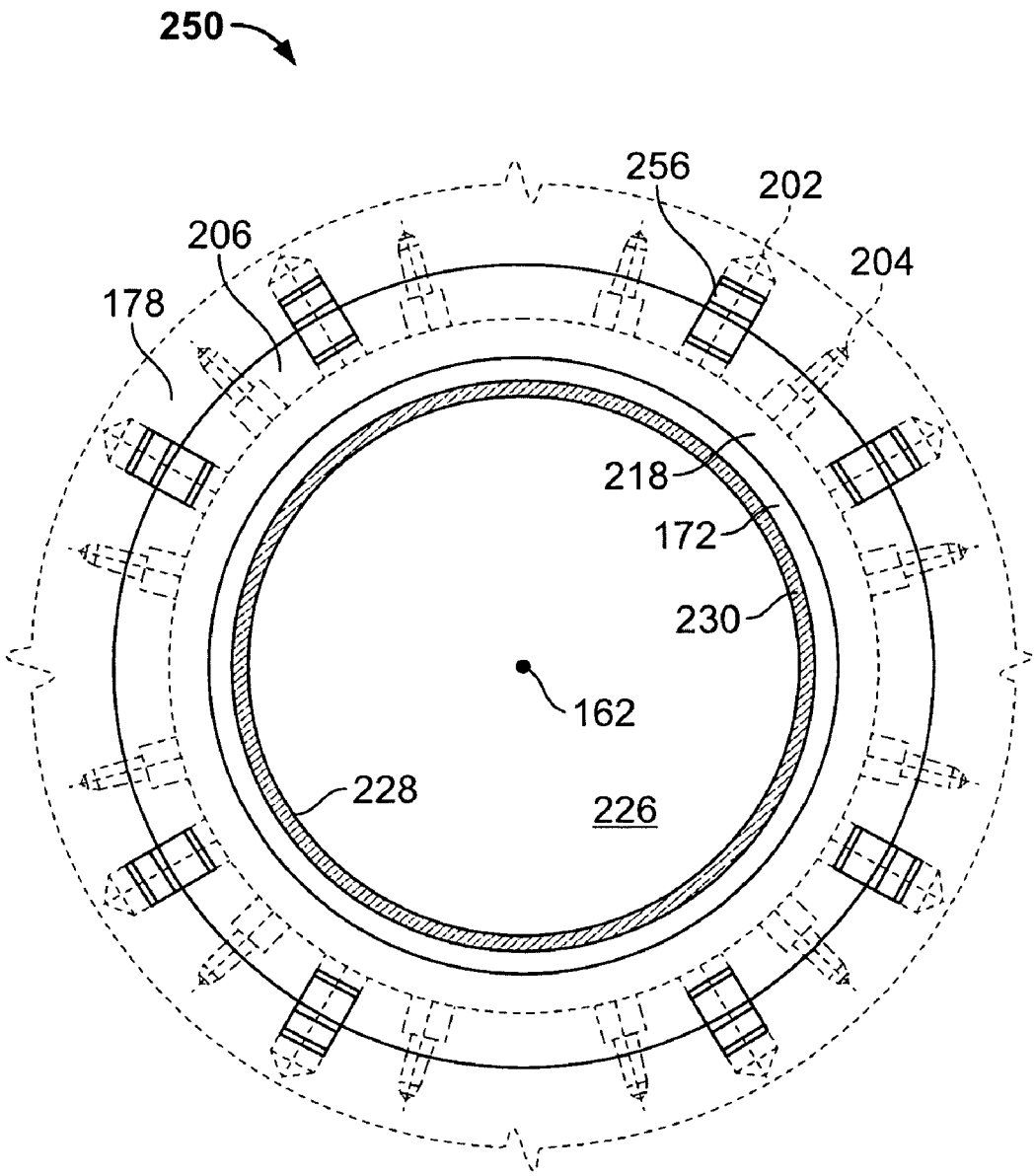
FIG. 9 is a schematic axial perspective of the exemplary diaphragm assembly after modification that may be used with the steam turbine engine in FIG. 1.

FIG. 9 is a schematic axial perspective of an exemplary diaphragm assembly 250 after modification that may be used with steam turbine engine 100 (shown in FIG. 1). As discussed above, forming diaphragm assembly 152 with two half sections logically applies to assembly 250 as well. Typically, a top half section of assembly 250 is rolled into substantially annular diaphragm groove 153 formed within nozzle carrier 150 (both shown in FIG. 2). Similarly, a bottom half section is inserted into carrier 150. At least one dowel 256 is inserted generally radially into passage 202 to facilitate axial, radial and circumferential alignment as well as to mitigate any potential for circumferential displacement as discussed above.

FIG. 9 also illustrates the exemplary embodiment for the number of and placement of dowel passages 202 and bolt passages 204 as well as the associated bolts 224 (shown in FIG. 7) and dowels 256. Alternatively, the dimensions of, the number of and the positioning of these components may be determined based on the dimensions of turbine engine 100.

Assembly 250 further has machined bore portion 178 coupled to diaphragm patch ring 206 as discussed above. Seal ring segment 172 is inserted into seal ring groove 218. Rotor 226 with rotor surface 228 and axial centerline 162 are illustrated for perspective. Gap 230 is formed between surface 28 and seal ring segment 172.

The methods and apparatus for a fabricating a turbine diaphragm assembly described herein facilitates operation of a turbine system. More specifically, the turbine diaphragm assembly as described above facilitates a more robust turbine steam seal configuration. Such steam seal configuration also facilitates efficiency, reliability, and reduced maintenance costs and turbine system outages.

Exemplary embodiments of turbine diaphragm assemblies as associated with turbine systems are described above in detail. The methods, apparatus and systems are not limited to the specific embodiments described herein nor to the specific illustrated turbine diaphragm assembly.

While the invention has been described in terms of various specific embodiments, those skilled in the art will recognize that the invention can be practiced with modification within the spirit and scope of the claims.

The invention claimed is:

1. A method of assembling a rotary machine having a casing extending at least partially around a rotor comprising:

providing a diaphragm patch ring;

assembling a diaphragm assembly by configuring a diaphragm bore portion to receive the diaphragm patch ring and forming a diaphragm patch member sub-assembly by coupling the diaphragm patch ring to the configured diaphragm bore portion, the diaphragm bore portion defining at least one dowel passage and at least one bolt passage;

inserting at least one dowel generally radially into the at least one dowel passage;

inserting at least one fastening bolt generally radially into the at least one bolt passage to secure the diaphragm patch ring to the diaphragm bore portion; and positioning the diaphragm assembly in a gap formed by the casing and the rotor.

2. A method of assembling a rotary machine in accordance with claim 1 wherein configuring a diaphragm bore portion to receive the diaphragm patch ring comprises forming a substantially annular radially inner mating surface via machining at least one radially outermost surface of the bore portion.

3. A method of assembling a rotary machine in accordance with claim 2 wherein configuring a diaphragm bore portion to receive the diaphragm patch ring further comprises machining the at least one dowel passage and the at least one bolt passage within the radially inner mating surface.

4. A method of assembling a rotary machine in accordance with claim 1 wherein forming a diaphragm patch member sub-assembly via coupling the diaphragm patch ring to the configured diaphragm bore portion comprises aligning the diaphragm patch ring with the diaphragm bore portion.

5. A method of assembling a rotary machine in accordance with claim 4 wherein aligning the diaphragm patch ring with the diaphragm bore portion comprises:

inserting a patch ring groove formed by at least one patch ring mating surface over a bore portion protrusion formed by at least one bore portion mating surface such that a friction fit is formed;

aligning a plurality of diaphragm patch ring dowel passages with a plurality of diaphragm bore portion dowel passages and inserting at least one dowel generally radially into at least one aligned pair of the dowel passages; and aligning a plurality of diaphragm patch ring bolt passages with a plurality of diaphragm bore portion bolt passages and inserting at least one fastening bolt generally radially into at least one aligned pair of the bolt passages.

6. A method of assembling a rotary machine in accordance with claim 1 wherein positioning the diaphragm assembly in a gap formed by the casing and the rotor comprises inserting the diaphragm assembly into a groove formed in a substantially annular radially inner surface of the casing.

7. A diaphragm assembly for a steam turbine comprising:

a substantially annular radially inner member configured to extend substantially circumferentially within said steam turbine, said inner member defining at least one dowel passage and at least one bolt passage; and a substantially annular diaphragm patch member sub-assembly configured to extend substantially circumferentially within said steam turbine, said sub-assembly comprises a substantially annular diaphragm patch ring comprising a substantially annular radially outer groove that facilitates aligning said patch ring relative to said inner member, said diaphragm patch member sub-assembly being coupled to said inner member with at least one dowel inserted in said dowel passage and at least one bolt inserted in said bolt passage.

8. A diaphragm assembly in accordance with claim 7 wherein said diaphragm patch ring comprises a mating portion, said mating portion forms a plurality of open passages, said open passages facilitate alignment and fastening of said patch ring to said inner member.

9. A diaphragm assembly in accordance with claim 8 wherein said mating portion comprises a substantially annular radially outer portion, said outer portion forms said substantially annular radially outer groove, said groove configured to extend substantially circumferentially within said steam turbine, said groove facilitates alignment and fastening of said diaphragm patch ring to said inner member.

10. A diaphragm assembly in accordance with claim 7 wherein said inner member comprises a bore portion, said bore portion forms each of said at least one dowel passage and said at least one bolt passage, said bore portion facilitates fastening said diaphragm patch ring to said inner member.

11. A diaphragm assembly in accordance with claim 10 wherein said bore portion forms a radially inner protrusion, said protrusion being inserted into said substantially annular radially outer groove formed in said diaphragm patch ring, said protrusion facilitates alignment and fastening of said diaphragm patch ring to said inner member.

12. A diaphragm assembly in accordance with claim 7 wherein said diaphragm patch ring forms a substantially annular radially innermost groove, said groove extending substantially circumferentially within said steam turbine, said groove configured to receive a substantially arcuate seal ring segment.

13. A diaphragm assembly in accordance with claim 8 wherein said diaphragm patch ring is coupled to said inner member via a friction fit between said inner member and said diaphragm patch ring, said at least one dowel and said at least one bolt are each inserted into a respective one of said plurality of open passages formed by said patch ring.

14. A rotary machine comprising:

at least one rotor;

at least one stationary machine casing extending at least partly circumferentially around said at least one rotor such that a clearance gap is defined between said at least one rotor and said at least one stationary machine casing;

at least one diaphragm assembly, said diaphragm assembly being positioned within the clearance gap defined between said at least one rotor and said at least one stationary machine casing, said diaphragm assembly comprising a substantially annular radially inner member configured to extend substantially circumferentially within said rotary machine, said inner member defining at least one dowel passage and at least one bolt passage, and a substantially annular diaphragm patch member sub-assembly configured to extend substantially circumferentially within said rotary machine, said sub-assembly comprises a substantially annular diaphragm patch ring comprising a radially outer groove that facilitates aligning of said patch ring to said inner member, said diaphragm patch member sub-assembly being coupled to said inner member with at least one dowel inserted into said dowel passage and at least one bolt inserted into said bolt passage.

15. A rotary machine in accordance with claim 14 wherein said diaphragm patch ring comprises a mating portion, said mating portion forms a plurality of open passages, said open passages facilitate alignment and fastening of said patch ring to said inner member.

16. A rotary machine in accordance with claim 15 wherein said mating portion comprises a substantially annular radially outer portion, said outer portion forms said annular radially outer groove, said groove configured to extend substantially circumferentially within said rotary machine, said groove facilitates alignment and fastening of said diaphragm patch ring to said inner member.

17. A rotary machine in accordance with claim 14 wherein said inner member comprises a bore portion, said bore portion forms each of said at least one dowel passage and said at least one bolt passage to facilitate fastening of said diaphragm patch ring to said inner member.

18. A rotary machine in accordance with claim 17 wherein said bore portion forms a radially inner protrusion, said protrusion being inserted into said annular radially outer groove formed in said diaphragm patch ring, said protrusion facilitates alignment and fastening of said diaphragm patch ring to said inner member.

19. A rotary machine in accordance with claim 17 wherein said diaphragm patch ring forms a substantially annular radially innermost groove, said groove extending substantially circumferentially within said rotary machine, said groove configured to receive a substantially arcuate seal ring segment.

20. A rotary machine in accordance with claim 15 wherein said diaphragm patch ring is coupled to said inner member via each of said at least one dowel and said at least one bolt, said at least one dowel and said at least one bolt are each inserted into a respective one of said plurality of open passages formed by said patch ring.

* * * * *